US006022101A

United States Patent [19]

Sabonis

[11] Patent Number: 6,022,101

[45] Date of Patent: Feb. 8, 2000

[54] PRINTER INK BOTTLE

[75] Inventor: Charles Sabonis, San Ramon, Calif.

[73] Assignee: Topaz Technologies, Inc., Sunnyvale, Calif.

[21] Appl. No.: 08/924,023

[22] Filed: Aug. 29, 1997

[51] Int. Cl.[7] ..... B41J 2/17

[52] U.S. Cl. ..... 347/84

[58] Field of Search ..... 347/85, 86, 7, 347/84; 215/247, 250, 307, 249, 248, 309; 220/203.02, 203.27, 203.29; 277/630, 637, 644; 141/346, 329, 325, 330, 18

[56] References Cited

U.S. PATENT DOCUMENTS

| | | | |
|---|---|---|---|
| 2,730,097 | 1/1956 | Cutter | 215/247 |
| 2,747,756 | 7/1956 | Hartop et al. | 215/247 |
| 3,215,299 | 11/1965 | Coanda et al. | 215/250 |
| 4,325,368 | 4/1982 | Kaemmerer | 215/247 |
| 4,441,621 | 4/1984 | Matukura et al. | 215/247 |
| 4,639,738 | 1/1987 | Young et al. . | |
| 4,976,894 | 12/1990 | Robinson | 215/247 |
| 5,162,817 | 11/1992 | Tajika et al. | 347/7 |
| 5,250,957 | 10/1993 | Onozato . | |
| 5,738,233 | 4/1998 | Burns | 215/247 |
| 5,788,388 | 8/1998 | Cowger et al. | 347/7 |
| 5,817,082 | 10/1998 | Niedospial, Jr. et al. | 215/247 |

FOREIGN PATENT DOCUMENTS

| | | | |
|---|---|---|---|
| 58-194552 | of 0000 | Japan . | |
| 63-276554 | 11/1988 | Japan | 347/86 |
| 4-133746 | 5/1992 | Japan | 347/86 |
| 5-96744 | 4/1993 | Japan | 347/86 |

*Primary Examiner*—N. Le
*Assistant Examiner*—Judy Nguyen
*Attorney, Agent, or Firm*—Lyon & Lyon LLP

[57] ABSTRACT

A color printer includes an ink delivery system having multiple ink stations for different color inks. Within each ink station, an ink bottle is positioned over an ink reservoir. Needles on the ink reservoir penetrate a septum in the ink bottles, to allow ink to flow into the reservoir. The ink bottles may be removed and replaced as the printer consumes ink, while the printer runs continuously, and with little or no ink leakage.

10 Claims, 10 Drawing Sheets

PRINTER INK BOTTLE

BACKGROUND OF THE INVENTION

The field of the invention is printers.

Printers are increasingly coming into widespread use, to print text, drawings, posters, and other graphic materials, including color printed materials. Moving carriage type printers are often used for printing large scale works. In these types of printers, a printhead is supported on a carriage which moves laterally back and forth across a recording medium, such as paper. Moving carriage type ink jet printers have flexible ink supply lines between the moving printhead and a fixed position ink reservoir. Rollers or other paper moving devices correspondingly move the paper longitudinally relative to the printhead. In this way, printing on any area of the paper can be accomplished.

Printing large scale works consumes large quantities of ink. To avoid degrading printing speed and quality, it is desirable to be able to replenish ink supplies without interrupting the printer, and, of course, without running out of ink before the work is complete.

Due to the need to frequently replenish ink supplies while printing large scale works, it is highly desirable that the ink replenishment operation can be performed quickly, reliably, and easily, and without leakage. For most typical home and office personal computer applications, loss of ink supply is only a minor inconvenience, since each work or document is usually short, and the printer is under the user's control. However, for larger scale works, including color works, loss of ink supply can result in significant losses of time, materials and labor.

To generate color works, combinations of different color inks are typically used, such as black, cyan, magenta and yellow inks, which, when appropriately combined, can make most desired colors. For proper operation, the different color inks must of course be supplied to the appropriate locations or parts of the print head. It is therefore desirable for the printer to have an ink delivery system which insures that correct color of ink is supplied to each port on the printhead.

Accordingly, there remains a need for an improved printer ink delivery system.

SUMMARY OF THE INVENTION

To these ends, a printer includes at least one ink station having an ink bottle positioned on an ink reservoir assembly. The ink bottle preferably has a neck, a septum, and a cap holding the septum in place. The ink reservoir assembly advantageously has a reservoir cover attached to a reservoir container. Preferably, ink and air cannulas or needles extend through a boss on the cover into the reservoir container.

In a preferred embodiment, the ink bottle has a septum stop within the bottle neck, with the septum including a disk section, and a septum recess on one side of the disk section. The cap advantageously has a central opening overlying the septum recess. The bottle can be quickly and easily replaced, to replenish the ink supply, without interrupting printing.

BRIEF DESCRIPTION OF THE DRAWINGS

Other objects and features of the invention will become apparent from the following detailed description taken in connection with the accompanying drawings. It should be understood, however, that the drawings are designed for the purpose of illustration only, and are not intended as a definition of the scope of the invention.

In the drawings, wherein similar reference characters denote similar elements throughout the several views.

DETAILED DESCRIPTION OF THE DRAWINGS

Figure 1:
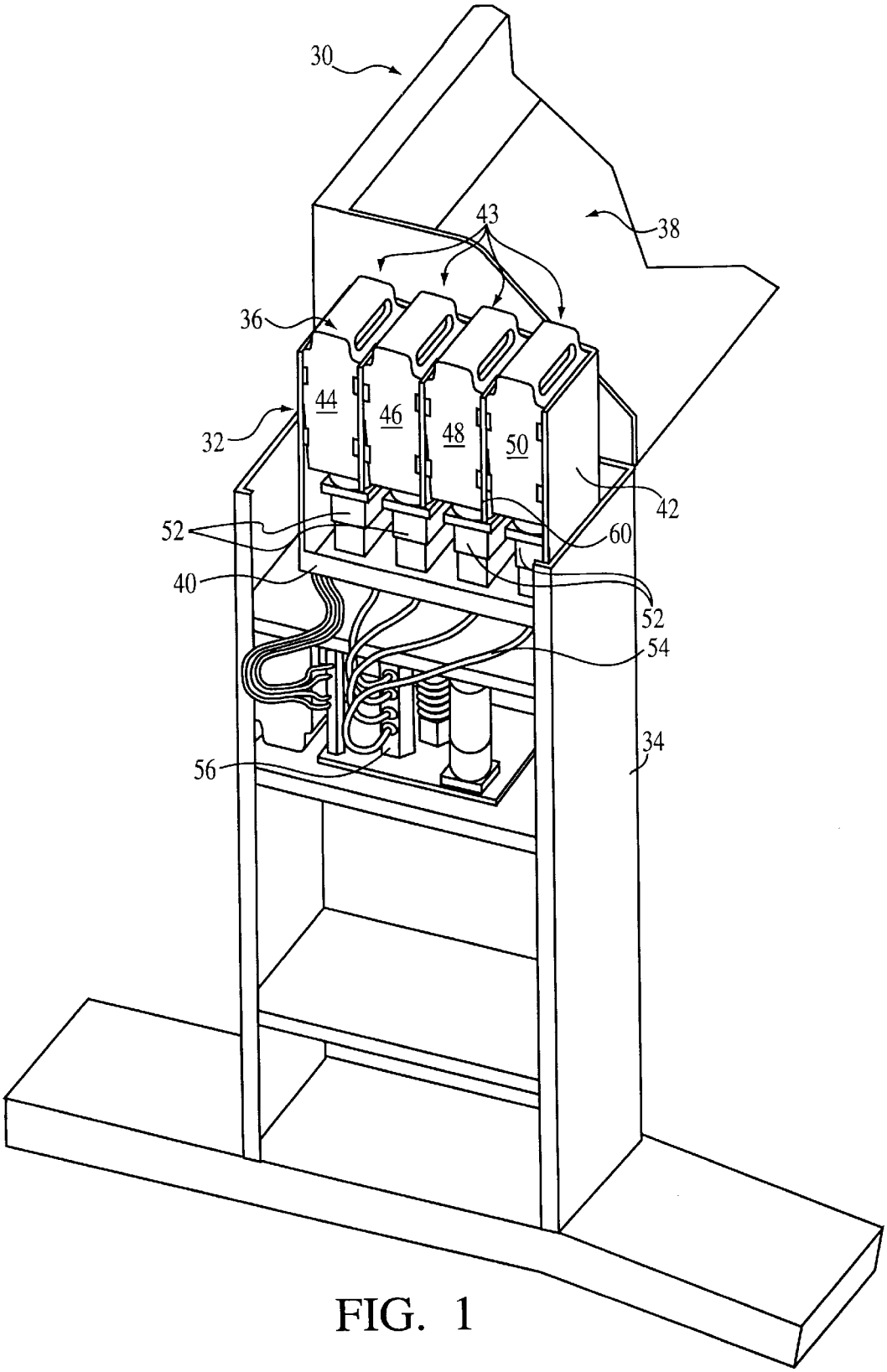
FIG. 1 is a perspective view of the present ink delivery system on a printer.

Turning now in detail to the drawings, as shown in FIG. 1, a printer 30 has a frame 34 at the left end 32 thereof. An ink delivery system 36 is contained within the frame 34, and may be entirely concealed by a frame cover (not shown).

The printer 30 has paper moving/handling devices 38, as is well known in the art. The ink delivery system 36 is connected via flexible ink delivery lines to a printhead which is moved laterally across the printer.

The ink delivery system 36 includes a bottle carrier 40 having an enclosure 42 and bottle guides 60. In a preferred embodiment, the ink delivery system 36 has 4 ink stations 43, which each ink station including an ink bottle, and an ink reservoir assembly 52. Preferably, the 4 ink stations 43 include a black ink bottle 44, a cyan ink bottle 46, a magenta ink bottle 48, and a yellow ink bottle 50.

Referring still to FIG. 1, the ink reservoir assemblies 52 are connected to a pump 56 via hoses 54. During priming, the pump 56 pumps ink from the reservoir assemblies 52 to flexible ink delivery lines which supply ink to the printhead (not shown). Thereafter, ink flows through the delivery lines to the printhead as needed.

Figure 2:
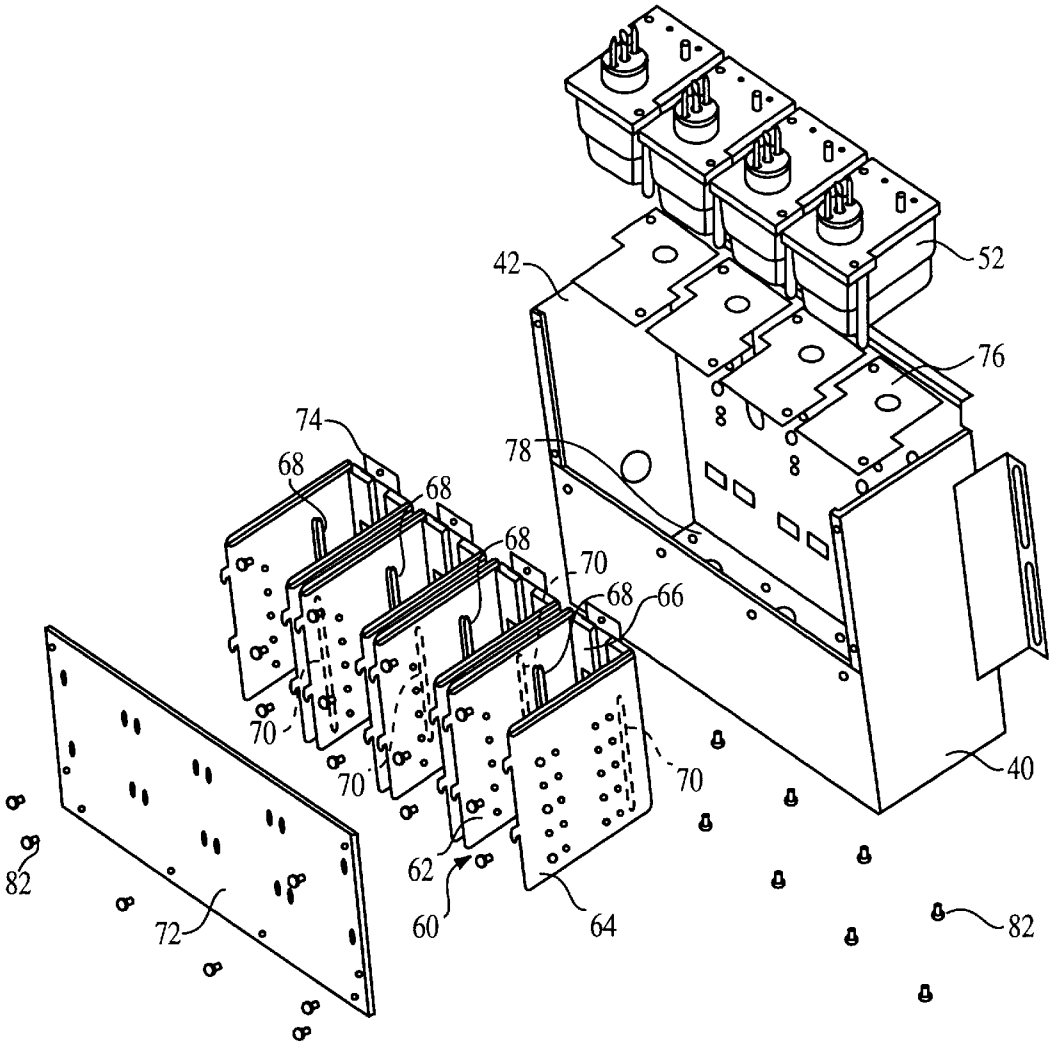
FIG. 2 is a n exploded perspective view of the ink reservoir assemblies and bottle carrier shown in FIG. 1.

Referring now to FIG. 2, each of the independent ink reservoir assemblies 52 is attached to the floor 78 of the bottle carrier 40 using screws 82 or other fasteners. A gasket 76 is positioned between the bottom surface of each ink reservoir assembly 52 and the floor 78, to help prevent leakage of ink from the carrier in case of a bottle leak. The bottle carrier 40 contains four bottle guides 60, with each bottle guide only accepting a single unique ink bottle. The 3-sided bottle guides 60 have a left side plate 62, a right side plate 64, and a back plate 66.

Figure 3:
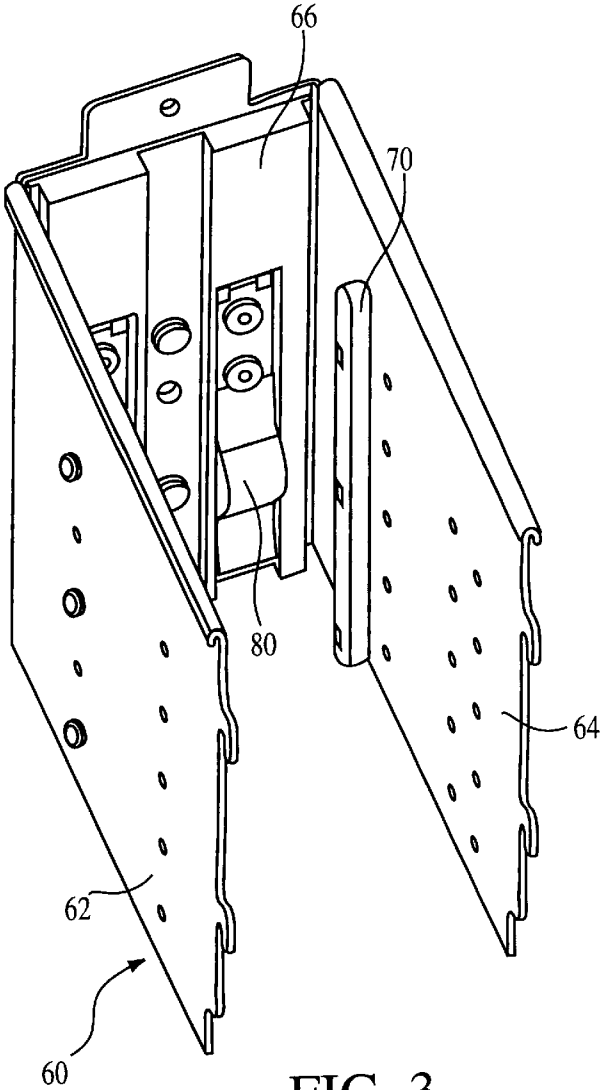
FIG. 3 is a perspective view of a single bottle guide.

Within each bottle guide 60, an ink type key 68 is attached at a specific position on the left side plate 62. The ink type keys 68 are each at the same relative position for all colors within each of the 4 bottle guides 60, and are therefore laterally aligned, as shown in FIG. 2. Referring to FIGS. 2 and 3, color keys 70 are similarly attached to the right side plates 64 of each bottle guide 60. However, unlike the ink type keys 68, the color keys 70 each have a unique position and are laterally staggered or offset within each bottle guide 60.

A window plate 72 is attached to the left and right side plates of each bottle guide 60, and also to the carrier enclosure 42 to enclose the ink bottles on all sides. The window plate 72 is advantageously transparent to allow for visual inspection of the ink level in each of the ink bottles. Alternatively, the window plate 72 can be made of an opaque material with slots for viewing. The bottle guides 60 are attached into the bottle carrier 40 with fasteners 82 extending through mounting tabs 74.

Figure 4:
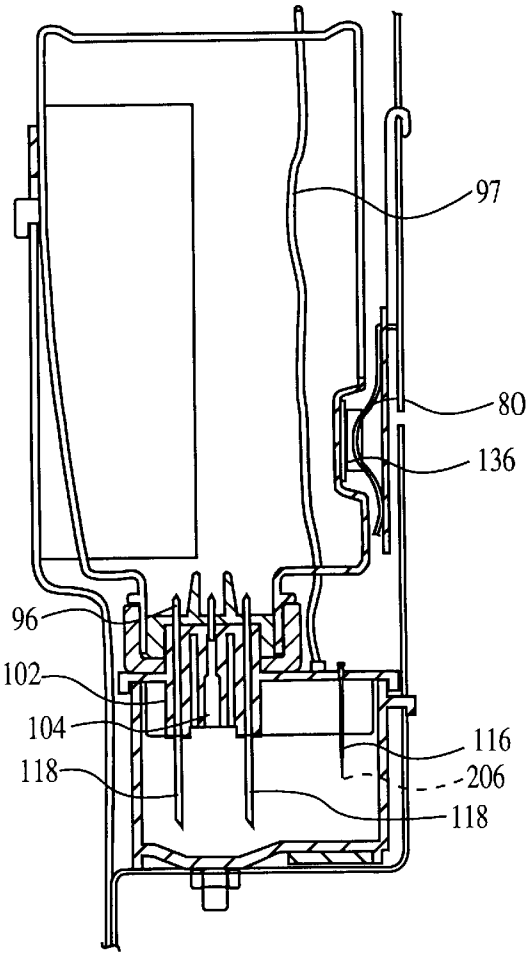
FIG. 4 is a section view of an ink bottle engaged onto an ink reservoir assembly.
Figure 19:
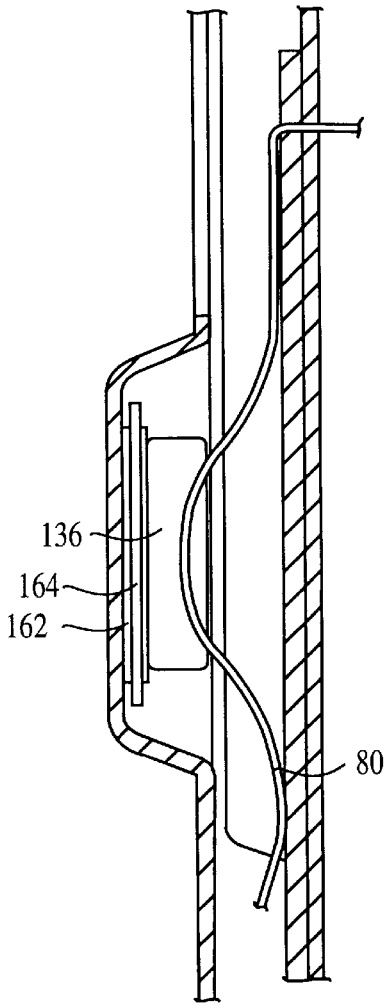
FIG. 19 is an enlarged partial section view of a memory chip on an ink bottle and a contact on the bottle carrier.
Figure 22:
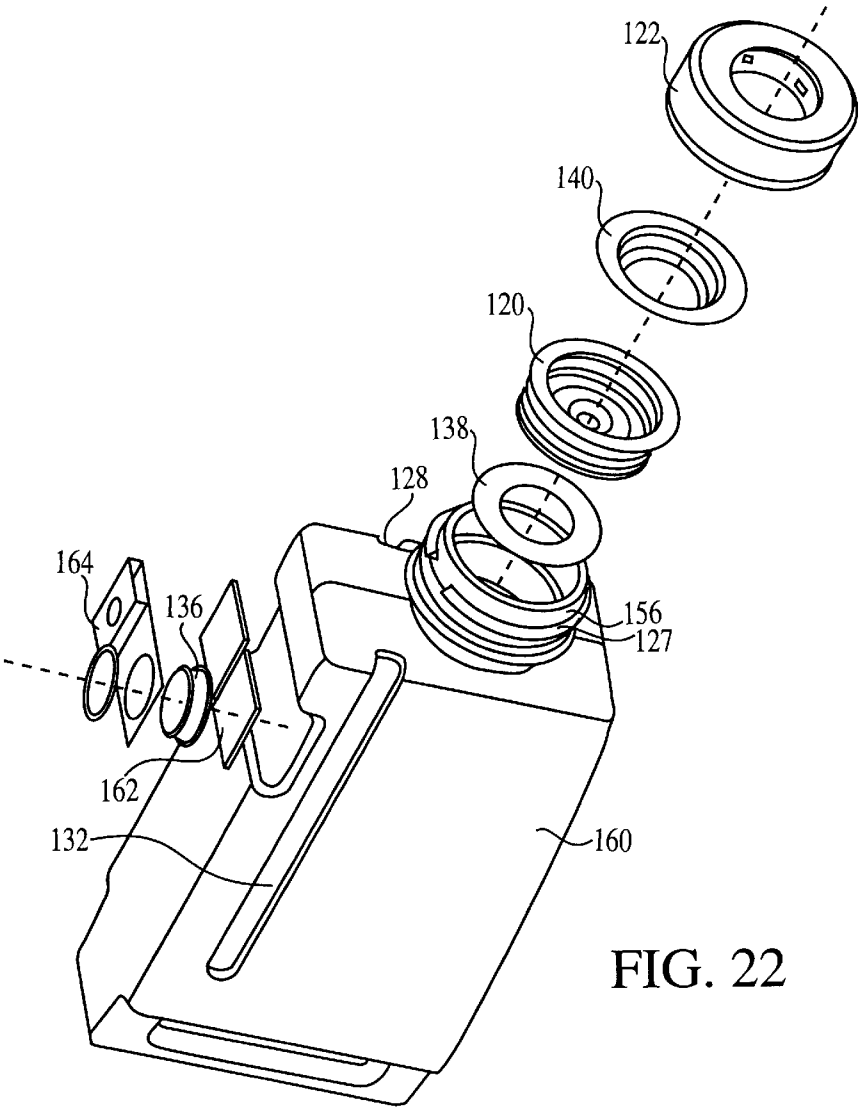
FIG. 22 is an exploded perspective view of an ink bottle.

As shown in FIG. 3, an electrical spring contact 80 is attached to the back plate 66 of each of the bottle guides 60. As shown in FIGS. 4, 19 and 22, an electronic memory chip 136 is attached to each of the ink bottles, using an adhesive strip 162 and a mounting plate 164. The contact 80 makes electrical connection to the memory chip 136 on each ink bottle. The contact 80 in turn is electrically linked to a controller/processor for the printer 30, which can therefore detect the presence of an ink bottle in the bottle guide 60, as well as the type and color of ink contained in the ink bottle, that information having been previously electronically stored in the memory chip 136. Additional information, such as date of manufacture, customer information, etc. may also be stored in the memory chip.

Figure 7:
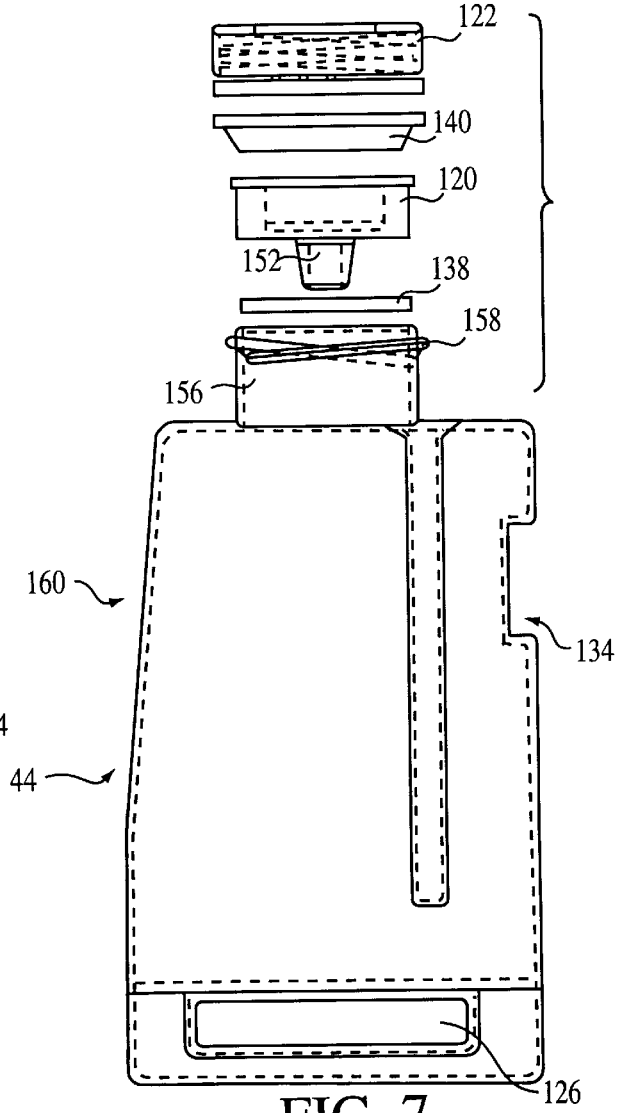
FIG. 7 is a right side elevation view thereof.
Figure 8:
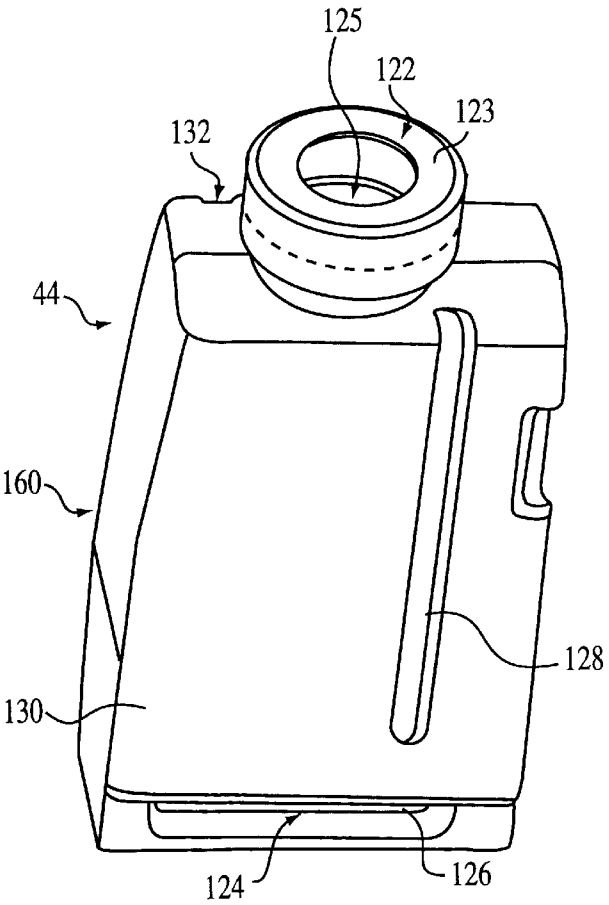
FIG. 8 is a perspective view of the assembled ink bottle of FIG. 10.

Referring momentarily to FIG. 7, 8 and 22, each of the ink bottles has an ink type slot 128 on one side, and a color slot 132 on the other side of the bottle, with the slots at specified positions on the bottles.

Figure 5:
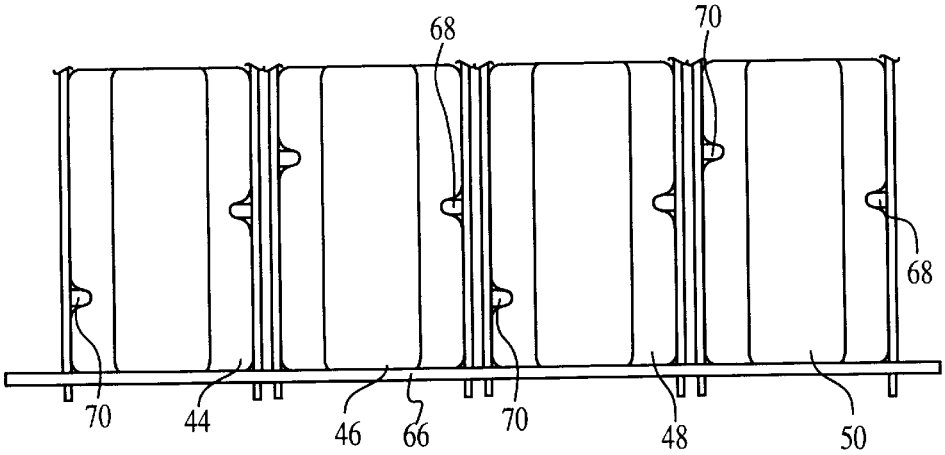
FIG. 5 is a plan view of four ink bottles installed into a bottle carrier.
Figure 6:
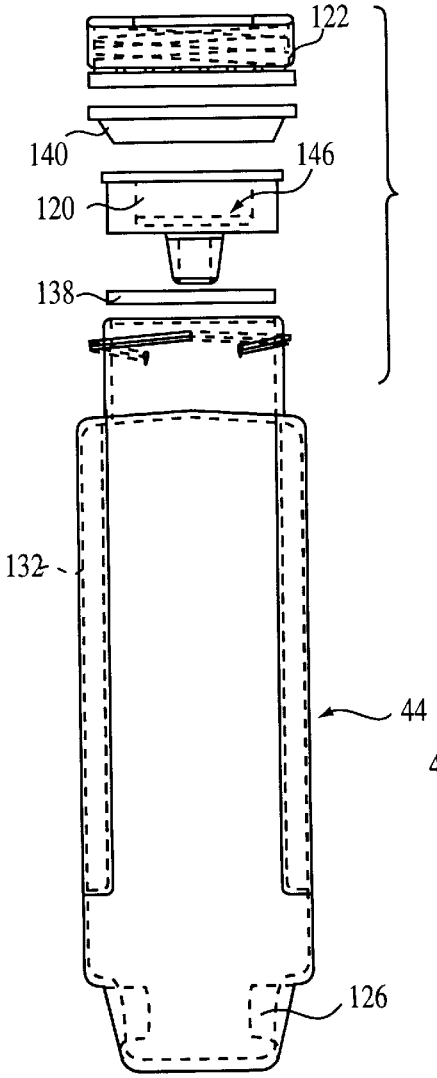
FIG. 6 is an exploded front view of an ink bottle.

Referring now to FIG. 5, within each bottle guide 60, the ink type keys 68 and color keys 70 prevent installation of an ink bottle, unless the ink bottle has a ink type slot 128 and color slot 130 which align respectively with the keys 68 and 70. This keying of the ink bottles to the bottle guides 60 insures that only the correct ink bottle can be installed within each bottle guide 60. Consequently, errors in placing the wrong color ink, or wrong type of ink into each bottle guide are largely eliminated.

While the preferred embodiment as shown in intended for use with two ink types (i.e., aqueous and solvent based) and four ink colors (i.e., black, cyan, magenta and yellow), other types, colors and number of inks may also be used. The ink bottles and the slots 128 and 130 can of course have various shapes, styles and relative locations, providing a very wide range of different visual appearances, while still providing their intended function. The ink bottles are shown in U.S. Design patent application Ser. No. 29/079,994, filed Jul. 29, 1997 incorporated by reference.

Figure 9:
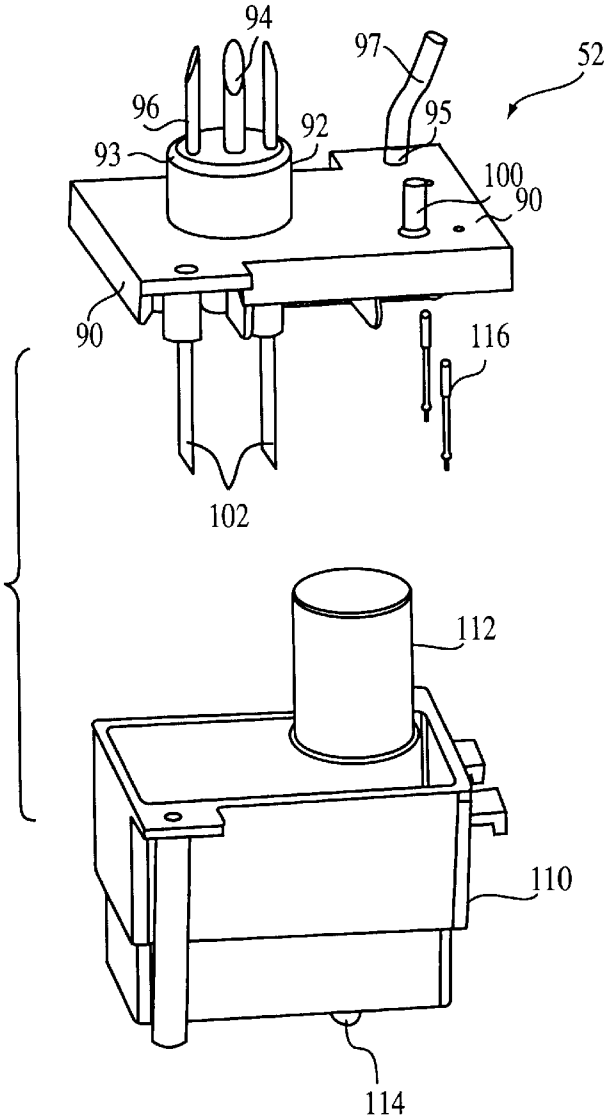
FIG. 9 is an exploded perspective view of an ink reservoir assembly.
Figure 10:
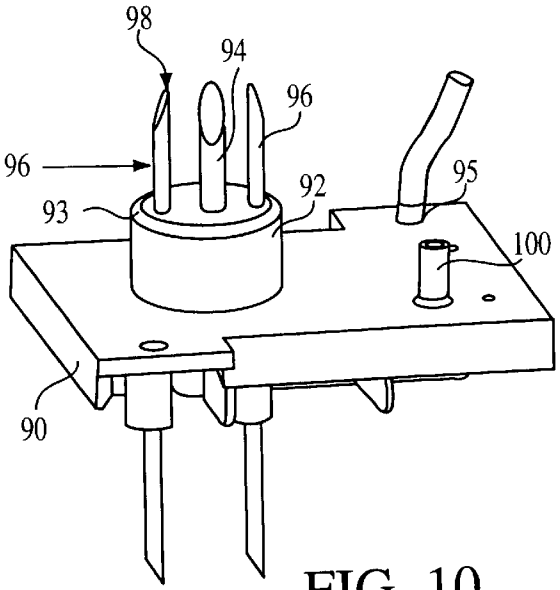
FIG. 10 is a perspective view of a reservoir cover.
Figure 12:
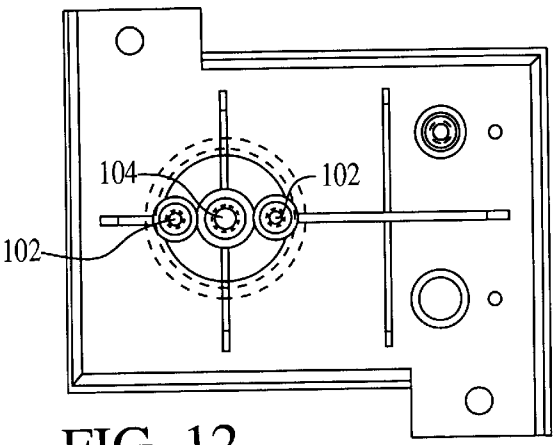
FIG. 12 is a bottom view thereof.
Figure 11:
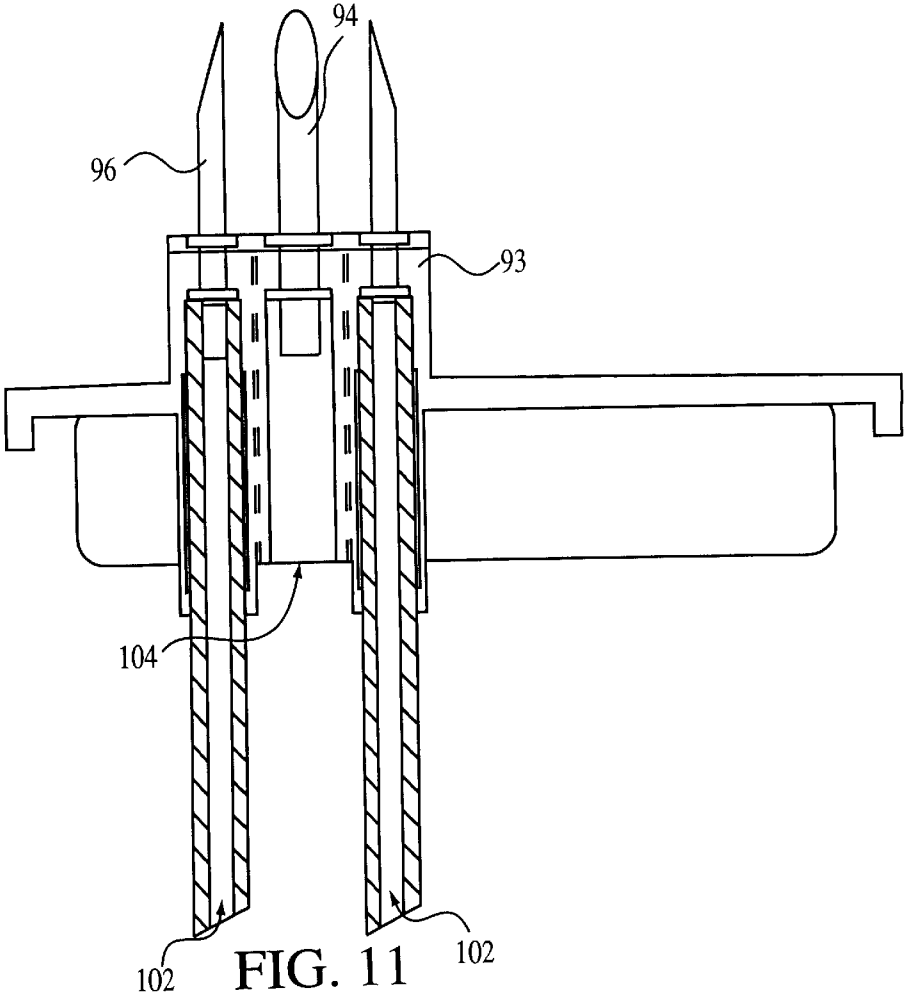
FIG. 11 is an enlarged side elevation view thereof.

Turning now to FIGS. 9, 10 and 11, each reservoir assembly 52 includes a reservoir cover 90. A cylindrical boss 92 extends upwardly from the top surface of the reservoir cover 90. The cylindrical or conical side surface of the boss 92 is joined to the flat top surface with a chamfered or radiused edge 93. Hollow ink cannulas 96, and a hollow air cannula 94, extend through the boss 92 and connect to ink tubes 102 and an air tube 104 extending through the reservoir cover 90, respectively, as best shown in FIG. 11. The cannulas or needles 94 and 96 have sharpened tips 98, similar to a hypodermic needle. Referring still to FIG. 11, the angles formed on the sharpened tips 98 of the two ink cannulas 96 extend towards each other, to form the acute included angle b, while the angle of the sharpened tip of the air cannula 94 is perpendicular to the angled tip of either of the ink cannulas 96. The inside diameter of each ink cannula 96 is the same as the inside diameter of the ink tubes, to avoid trapping air and causing a discontinuous ink flow. Preferably the ink cannula 96 and the ink tube 102 are made of a single metal tube section extending through the cover. An electrical connector 100 also extends through the reservoir cover 90.

Figure 13:
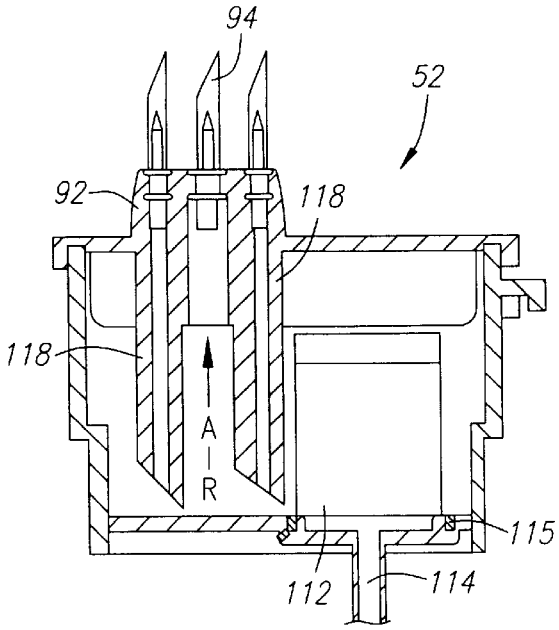
FIG. 13 is an enlarged partial section view of the ink reservoir assembly shown in FIG. 9.
Figure 14:
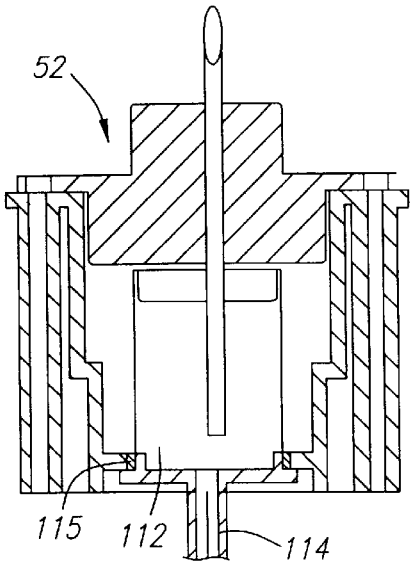
FIG. 14 is an end view thereof.

As shown in FIG. 9, a reservoir container 110 has an outlet 114 through its bottom surface. As best shown in FIGS. 9, 13 and 14, a filter 112, preferably a metal mesh, is attached to the floor of the reservoir container 110, preferably via an ultrasonic seal joint 115. The ink tubes 102 extend down from the underside of the reservoir cover 90, to a position just above the floor of the reservoir container 110, as shown in FIGS. 4 and 13. An air vent-tube 97 extends from the air vent 95 in the cover 90 up alongside the full height of the bottle (about 7 inches in the embodiment shown,) to prevent ink leakage from the air vent in an unanticipated overflow condition.

Ink level contacts 116 extend from the underside of the reservoir cover 90 into the reservoir container 110 down to an "ink out" level 206, as shown in FIG. 4. The ink level contacts 116 are electrically connected to the connector 100, which in turn is electrically connected to a printer controller/processor, for monitoring the ink level within the container 110. The distance D in FIG. 4 is preferably maximized to provide a greater ink head height.

Referring to FIGS. 6, 7, 8, 15 and 22 while the e.g., black ink bottle 44 is shown, the other ink bottles 46, 48, and 50 are of the same design, except for the locations of the color slots 132. The ink bottles are supplied prefilled with ink and are sealed. A bottle neck 156 is attached and extends upwardly from the bottle body 160. Screw threads 158 and a cap stop 127 are provided on the external cylindrical surface of the bottle neck 156. The ink bottles are preferably molded as a single integral hollow unit. If the bottles are made of a transparent or translucent plastic material, visual inspection of the color and level of the ink in the bottle can be made. The ink bottles preferably have indentions 126 at the bottom, to form a gripping handle 124. The shape, size and position of the indentations may of course vary widely, so long as a gripping area is provided.

Figure 15:
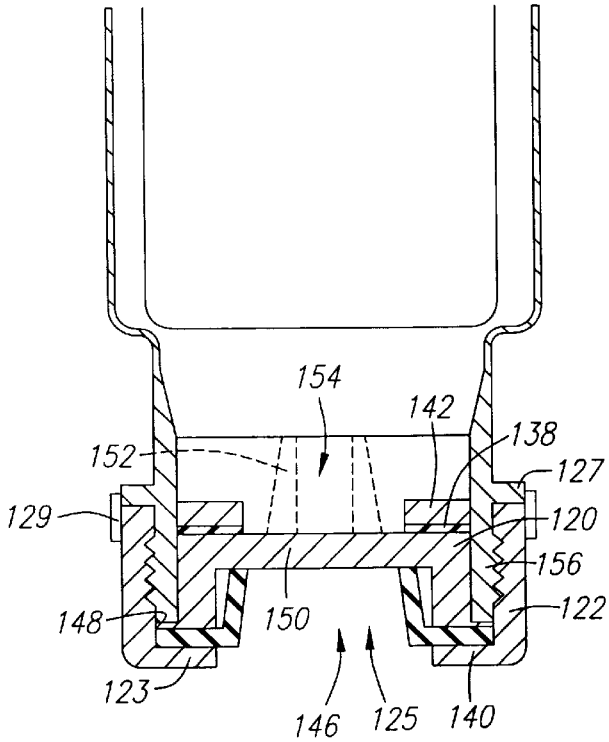
FIG. 15 is an inverted partial front section view of the upper end of the bottle shown in FIG. 8.

As shown in FIGS. 7 and 15, a septum 120 is located within the bottle neck 156. The septum 120 has a preferably centrally located septum recess 146. A septum rim 148 surrounds and extends radially outwardly around the recess 146. An optional nose section 152, when used, extends inwardly towards the bottle body 160 from a septum disk 150. A blind nose bore 154 extends through the nose 152 to the septum disk 150.

An annular septum stop 142 extends radially inwardly from the bottle neck 156. A support plate 138, e.g., in the form of a large washer, is optionally placed next to the molded in septum stop 142. The support plate 138 prevents excessive deflection of the elastomeric septum during piercing of the septum. The septum stop 142 is preferably positioned in the bottle neck 156 so that the septum disk 150 comes to rest against the septum stop 142 (or the support plate 138, if used) as the septum rim 148 comes to rest against the end of the bottle neck 156.

Referring still to FIG. 15, a cone-shaped thrust washer 140 is placed over the septum rim 148. A bottle cap 122 is threaded onto the threads 158 of the bottle neck 156. An inwardly extending radial lip 123 on the cap 122 overlies the thrust washer 140, and clamps the septum rim 148 against the end of the bottle neck 156. The cap stop 127 extending outwardly from the bottle neck 156 limits the tightening movement of the cap 122. The thrust washer 140 helps to distribute compressive forces and better maintains the septum rim 148 in position as the cap is tightened.

After the bottle is filled with ink and the septum and cap are installed, a cap seal 129, e.g., a tape strip, maybe adhered to the cap and the bottle neck. The cap seal 129, when damaged or broken, may provide may provide an indication of tampering. As shown in FIG. 15, the cap 122 has a central opening 125 aligned with the septum recess 146.

The septum 120 is preferably made of natural rubber, polyisoprene, or other elastomeric material, which is compatible with inks and has good sealing properties after puncture. The support plate 138 and thrust washer 140 are preferably metal, to better distribute loads on the septum and reduce pinching or binding as the cap is tightened.

In use, the filled ink bottles are placed into the bottle guide 60 of the bottle carrier 40 to provide ink to the printer 30. Each ink bottle is keyed to a specific bottle guide 60, via the interaction of the keys 68 and 70 in the bottle guides 60, and the slots 128 and 132 on the bottles. Thus, each bottle guide 60 will accept only an ink bottle having the appropriate color, and appropriate type of ink.

As the slots 128 and 132 of each bottle engage their respective keys 68 and 70 in the bottle guides 60, the bottle is aligned and positioned relative to the reservoir assembly 52 located at the bottom of the bottle guide 60.

Figure 16:
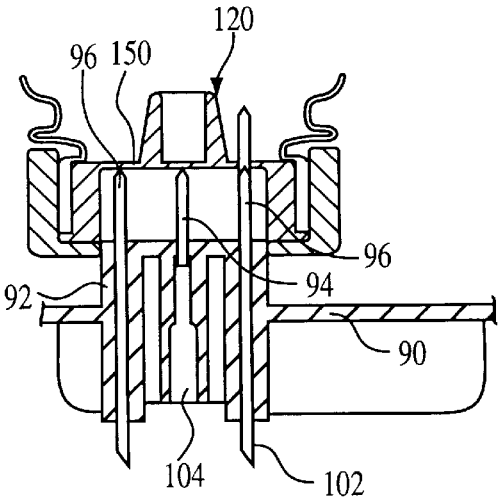
FIG. 16 is a partial section view showing initial engagement of an ink bottle onto a reservoir assembly.
Figure 17:
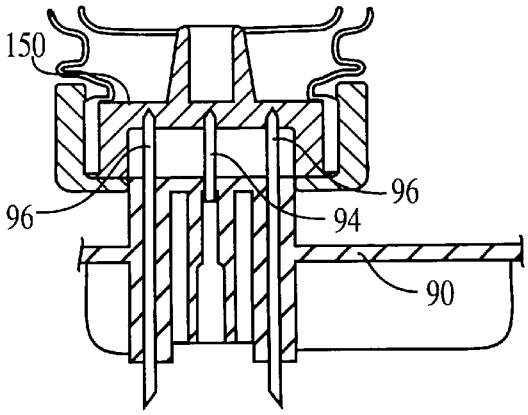
FIG. 17 is a partial section view thereof in an intermediate engagement position.
Figure 18:
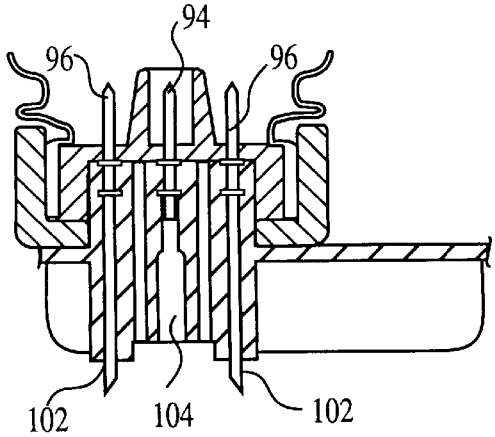
FIG. 18 is a partial section view thereof showing the ink bottle fully engaged onto the reservoir assembly.
Figure 23:
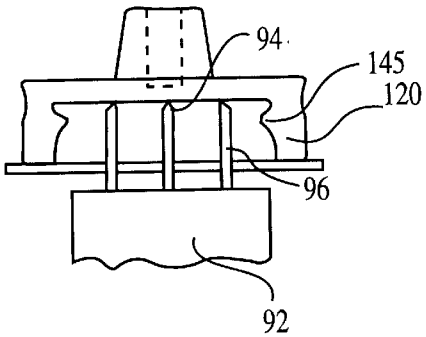
FIG. 23 is an enlarged view of the septum shown in FIGS. 8 and 15.

Referring now to FIGS. 16, 17 and 18, as each (inverted) ink bottle is pushed down within its bottle guide 60, the septum 120 approaches the needles 94 and 96 extending upwardly from the boss 92 on the reservoir cover 90. The needles 94 and 96 preferably extend to the same vertical height, so that they engage the septum disk 150 simultaneously. The cylindrical body of the boss 92 (which may have a slight conical taper for ease of entry) slides into the septum recess 146, providing a seal between the boss 92 and septum 120, before the septum is pierced by the needles. This avoids or reduces ink leakage which might occur as the needles penetrate the septum. As shown in FIG. 23, a lip 145 on the septum slidingly engages and seals against the boss 92. As this occurs, the septum stretches radially outwardly as it engages the boss 92. The lip reduces insertion/withdrawal forces while providing a reliable seal.

Referring to FIG. 17, as the bottle continues to be pushed down, the cannulas or needles 94 and 96 pierce through the septum disk 150. FIG. 18 shows the bottle fully installed, with the cannulas 94 and 96 extending fully through the septum and into the bottle neck 156. The flat top surface of the boss 92 is flush against, or near flush against, the septum disk 150.

As shown in FIG. 18, with the cannulas pierced through the septum, a flow path of ink out of the bottle is established through the ink cannulas 96 and tubes 102 into the reservoir container 110. Referring momentarily to FIG. 4, ink flows out of the bottle through the ink cannulas 96 and ink tubes 102 to fill up the reservoir container 110. At the same time, air within the reservoir container 110 flows upwardly through the air tube 104 and air cannula 94 into the ink bottle, to prevent a vacuum from forming in the ink bottle, which would stop the ink flow. The vent 95 in the top of the reservoir cover 90 allows ambient air to flow into the reservoir. The bottom ends of the ink tubes 102 are preferably angled to prevent a meniscus from forming and stopping the ink flow. Ink continues to flow from the bottle into the reservoir container, until the level of ink reaches the air tube 104, when the ink in the reservoir container 110 shuts off air flow into the bottle, thereby preventing overfilling.

Ink in the reservoir container 110 flows through the filter 112 through the outlet 114 and to the hoses 54 and pump 56, as shown in FIG. 1, as the printer 30 consumes ink. As ink flows out of the reservoir container 110 and the level of ink drops, air can once again flow through the air tube 104 into the ink bottle, to allow additional ink to flow into the reservoir container 110. The ink level within the reservoir is therefore generally automatically maintained at a level near the vertical height of the air tube 104.

Ink level contacts 116 extend from the reservoir cover 90 into the reservoir cup 110, and detect the ink level, using known electrical techniques. When the level of ink drops below the ink level contacts 116, the printer 30 detects a low ink condition. The printer can then sound an alarm or signal to alert the operator that an ink bottle must be replaced.

The operator, by grasping the handle 124 pulls the ink bottle up to remove it. As the cannulas or needles 94 and 96 are withdrawn from the septum 120, the pierced openings in the septum close and reseal, via the elastic nature of the septum material. This resealing occurs before the septum recess 146 moves off the boss 92, reducing or eliminating leakage. The printer 30 continues to operate, as the reservoir container 110 is still partially filled with ink, even though the ink bottle is removed. A replacement ink bottle is then installed onto the reservoir, as described above, and the supply of ink in the reservoir container is replenished. As the reservoir container 110 is replenished before all of the ink is consumed, the printer can run continuously. The disadvantages of interrupting the printer, such as down time, creation of bubbles in the ink lines, etc. are avoided.

The orientation of the cannula tips 98, as shown in FIG. 11, assist in piercing the septum. As the ink cannula 96 engage the septum, the opposing angles on their tips cause the septum to stretch slightly, allowing the sharp cannula tip to penetrate more easily.

The filter 112 screens out particles and other solid contaminants in the ink, and prevents them from entering into the ink lines. The filter 112 also tends to regulate flow of ink through the outlet 114.

Referring to FIG. 15, the septum stop 142, and the septum support 138 (if used) back up the septum disk 150 to prevent excess deflection of the septum disk as the cannulas pierce through the septum. The septum 120 may be made with or without the nose 152, for the embodiment described above. Without the nose 152, the septum disk 150 is flat on both sides. The nose provides support for septum.

Figure 20:
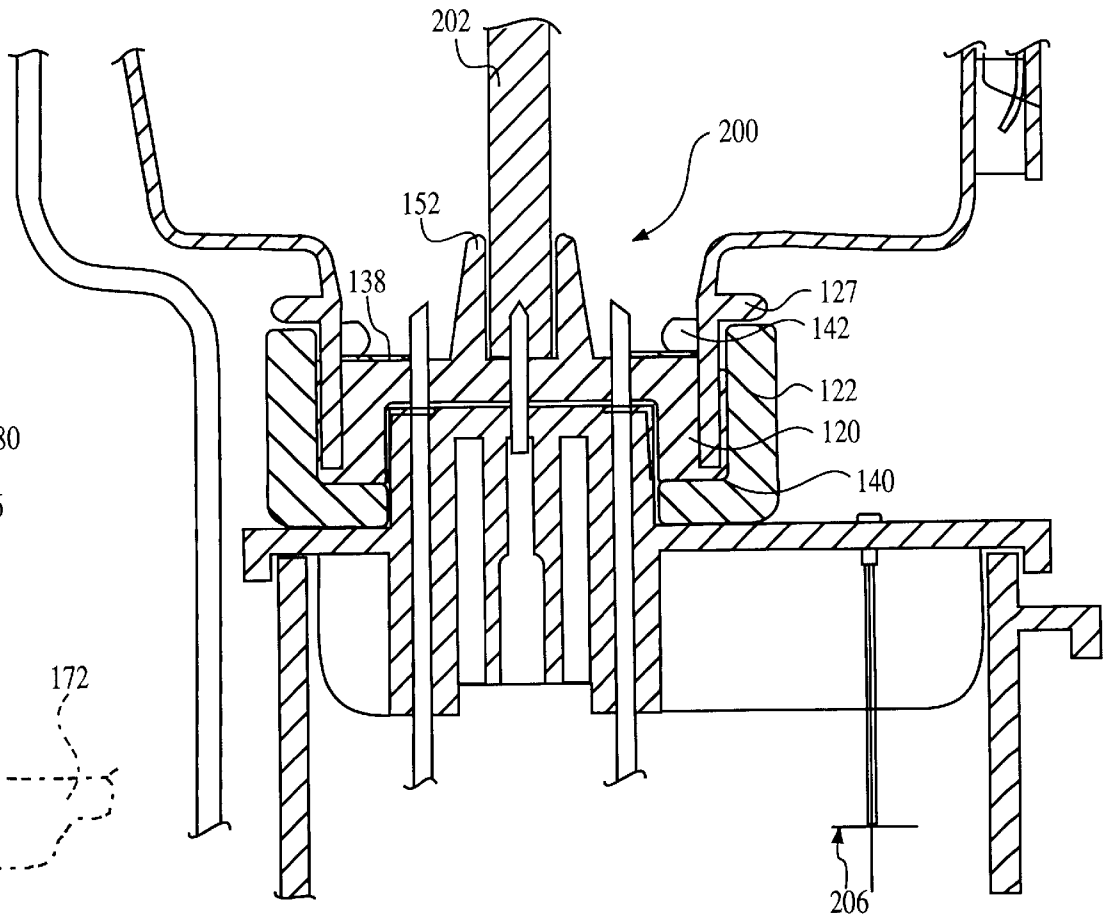
FIG. 20 is an enlarged partial section view of the upper end of an ink bottle engaged onto an ink reservoir assembly, showing an alternate embodiment of the invention having a standpipe.
Figure 21:
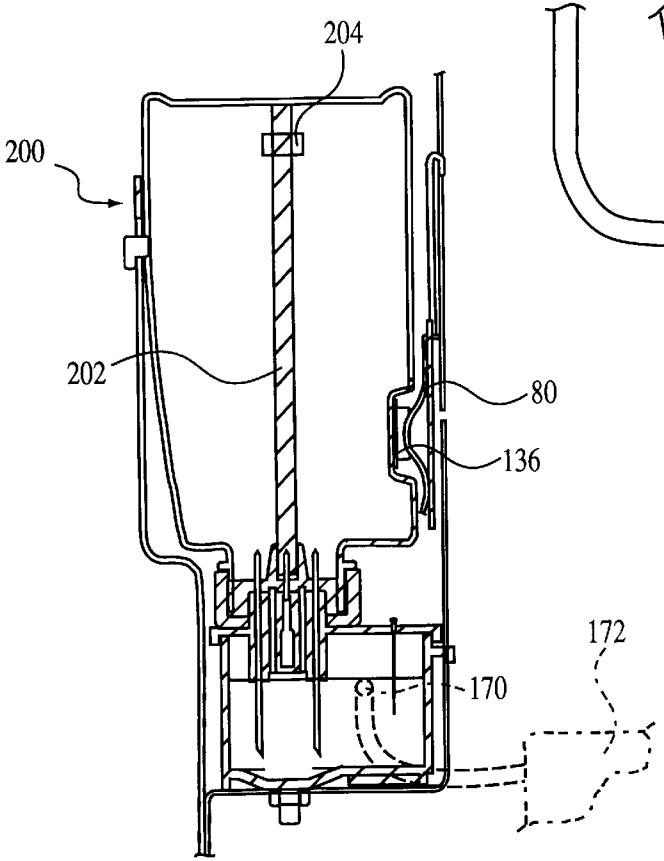
FIG. 21 is a full section view thereof.

Referring now to FIGS. 20 and 21, in an alternative embodiment, the septum 120 includes a nose 152. A hollow stand pipe 202 is secured into the nose bore 154 of the nose 152 on the septum 120. The standpipe 202 extends upwardly from the septum 120 to a position just below the bottom surface of the bottle. A porous plug or a one-way valve 204 may optionally be provided at the top end of the standpipe 202. In this embodiment, air bubbles travel up into the bottle inside of standpipe 202. Gurgling is therefore reduced.

As also shown in FIG. 21, an overflow drain 170 leading to a waste container 172 may be provided in the reservoir container just above the level of the air tube 104, to prevent overflow (if the ink level regulation by closing off the air tube 104 fails, due to bottle over pressure, etc.)

Thus, a novel ink bottle, ink delivery system, and printer have been shown and described. Various changes, modifications, and uses of equivalents may of course be made, without departing from the spirit and scope of the invention. The invention, therefore, should not be restricted, except by the following claims.

What is claimed is:

1. An ink bottle comprising:

a bottle body;

a bottle neck on the bottle body;

a septum stop within the bottle neck;

a septum substantially within the bottle neck, the septum including a septum disk section having an outer perimeter flat against the septum stop and a septum recess extending into the bottle neck; and a cap threaded onto the bottle neck, the cap having a central opening overlying the septum recess.

2. The ink bottle of claim 1 further comprising a septum support plate between the septum stop and the outer perimeter of the septum disk section and with the septum disk section parallel to the septum stop.

3. The ink bottle of claim 1 wherein the septum further includes a septum rim overlying an end surface of the bottle neck, and the cap has a radial lip compressing the septum rim against the end surface.

4. The ink bottle of claim 3 further comprising a thrust washer between the radial lip and the septum rim.

5. The ink bottle of claim 1 further comprising a cap stop attached to, and extending radially outwardly from the bottle neck.

6. The ink bottle of claim 1 further comprising a memory chip attached to an outside surface of the bottle.

7. The ink bottle of claim 1 further comprising at least one key slot on an outside surface of the bottle.

8. The ink bottle of claim 1 further comprising a handle on the bottle opposite to the bottle neck.

9. The ink bottle of claim 1 further comprising a cap seal extending between the cap and the bottle neck.

10. The ink bottle of claim 1 wherein the septum includes a nose, extending from the septum disk section towards the bottle body, and with the septum disk section around the nose being flat, further comprising a standpipe supported in the nose and extending into the bottle.

* * * * *